US011783974B2

(12) United States Patent
Harada et al.

(10) Patent No.: US 11,783,974 B2
(45) Date of Patent: Oct. 10, 2023

(54) SOFT MAGNETIC ALLOY AND MAGNETIC DEVICE

(71) Applicant: TDK CORPORATION, Tokyo (JP)

(72) Inventors: Akihiro Harada, Tokyo (JP); Hiroyuki Matsumoto, Tokyo (JP); Kenji Horino, Tokyo (JP); Kazuhiro Yoshidome, Tokyo (JP); Akito Hasegawa, Tokyo (JP); Hajime Amano, Tokyo (JP); Kensuke Ara, Tokyo (JP); Seigo Tokoro, Tokyo (JP)

(73) Assignee: TDK CORPORATION, Tokyo (JP)

( * ) Notice: Subject to any disclaimer, the term of this patent is extended or adjusted under 35 U.S.C. 154(b) by 206 days.

(21) Appl. No.: 15/881,227

(22) Filed: Jan. 26, 2018

(65) Prior Publication Data

US 2018/0218813 A1 Aug. 2, 2018

(30) Foreign Application Priority Data

Jan. 30, 2017 (JP) ..... 2017-014774

(51) Int. Cl.

| | |
|---|---|
| ***H01F 1/153*** | (2006.01) |
| ***C22C 33/00*** | (2006.01) |
| ***C22C 38/08*** | (2006.01) |
| ***C22C 38/00*** | (2006.01) |
| ***C22C 38/06*** | (2006.01) |
| ***H01F 1/147*** | (2006.01) |
| ***C22C 33/02*** | (2006.01) |
| ***C22C 38/10*** | (2006.01) |
| ***C22C 45/02*** | (2006.01) |
| ***C22C 38/18*** | (2006.01) |
| ***C22C 38/04*** | (2006.01) |
| ***C22C 38/14*** | (2006.01) |
| ***C22C 38/60*** | (2006.01) |
| ***C22C 38/12*** | (2006.01) |
| ***C22C 38/32*** | (2006.01) |
| ***B22F 1/07*** | (2022.01) |
| ***H01F 27/25*** | (2006.01) |
| ***H01F 41/02*** | (2006.01) |
| ***B22F 9/00*** | (2006.01) |
| ***C22C 45/00*** | (2023.01) |

(52) U.S. Cl.

CPC ..... *H01F 1/15333* (2013.01); *B22F 1/07* (2022.01); *C22C 33/003* (2013.01); *C22C 33/02* (2013.01); *C22C 38/002* (2013.01); *C22C 38/005* (2013.01); *C22C 38/007* (2013.01); *C22C 38/008* (2013.01); *C22C 38/04* (2013.01); *C22C 38/06* (2013.01); *C22C 38/08* (2013.01); *C22C 38/10* (2013.01); *C22C 38/12* (2013.01); *C22C 38/14* (2013.01); *C22C 38/18* (2013.01); *C22C 38/32* (2013.01); *C22C 38/60* (2013.01); *C22C 45/02* (2013.01); *H01F 1/14708* (2013.01); *H01F 1/15308* (2013.01); *H01F 1/15325* (2013.01); *H01F 1/15341* (2013.01); *H01F 27/25* (2013.01); *H01F 41/0226* (2013.01); *B22F 9/002* (2013.01); *C22C 45/008* (2013.01); *C22C 2202/02* (2013.01)

(58) Field of Classification Search

CPC ..... C22C 38/002–60; C22C 45/02; C22C 33/003; C22C 2202/02; C22C 45/008; C22C 2200/04; B22F 1/0044; B22F 9/002; H01F 1/12–447; H01F 1/153–15341; H01F 1/147–15333

See application file for complete search history.

(56) References Cited

U.S. PATENT DOCUMENTS

| | | | | |
|---|---|---|---|---|
| 5,192,375 | A * | 3/1993 | Sawa | C22C 45/02 148/302 |
| 5,252,148 | A * | 10/1993 | Shigeta | C22C 45/02 148/305 |
| 5,474,624 | A * | 12/1995 | Suzuki | C22C 45/00 148/120 |
| 5,509,975 | A * | 4/1996 | Kojima | B22F 3/006 148/104 |
| 5,958,153 | A * | 9/1999 | Sakamoto | H01F 27/24 148/304 |
| 6,190,465 | B1 * | 2/2001 | Coutu | C22F 1/10 148/315 |

(Continued)

FOREIGN PATENT DOCUMENTS

| | | |
|---|---|---|
| EP | 0455113 A2 | 11/1991 |
| EP | 3093364 A1 | 11/2016 |

(Continued)

OTHER PUBLICATIONS

S. Tumanski. Jun. 23, 2011, Magnetic Materials from: Handbook of Magnetic Measurements; CRC Press (Year: 2011).*

*Primary Examiner* — Kevin E Yoon
*Assistant Examiner* — Austin Pollock
(74) *Attorney, Agent, or Firm* — Oliff PLC

(57) ABSTRACT

A soft magnetic alloy comprising a main component having a compositional formula of $((Fe_{(1-(\alpha+\beta))}X1_{\alpha}X2_{\beta})_{(1-(a+b+c))}M_aB_bCr_c)_{1-d}C_d$, and a sub component including P, S and Ti, wherein X1 is selected from the group Co and Ni, X2 is selected from the group Al, Mn, Ag, Zn, Sn, As, Sb, Bi and rare earth elements, "M" is selected from the group Nb, Hf, Zr, Ta, Mo, W and V, $0.030 \leq a \leq 0.14$, $0.005 \leq b \leq 0.20$, $0 < c \leq 0.040$, $0 \leq d \leq 0.040$, $\alpha \geq 0$, $\beta \geq 0$, and $0 \leq \alpha+\beta \leq 0.50$ are satisfied, when soft magnetic alloy is 100 wt %, P is 0.001 to 0.050 wt %, S is 0.001 to 0.050 wt %, and Ti is 0.001 to 0.080 wt %, and when a value obtained by dividing P by S is P/S, then P/S satisfies $0.10 \leq P/S \leq 10$.

17 Claims, No Drawings

(56) References Cited

U.S. PATENT DOCUMENTS

| | | | | |
|---|---|---|---|---|
| 6,425,960 | B1 * | 7/2002 | Yoshizawa | H01F 1/15308 148/121 |
| 2009/0065100 | A1 * | 3/2009 | Yoshizawa | H01F 1/15308 148/305 |
| 2009/0206975 | A1 * | 8/2009 | Nuetzel | H01F 1/15308 336/233 |
| 2010/0043927 | A1 * | 2/2010 | Makino | C22C 38/20 148/612 |
| 2010/0084056 | A1 * | 4/2010 | Ohta | C22C 45/02 148/540 |
| 2010/0097171 | A1 * | 4/2010 | Urata | C21D 8/1211 336/233 |
| 2011/0272065 | A1 * | 11/2011 | Ohta | B82Y 25/00 148/540 |
| 2015/0159256 | A1 * | 6/2015 | Shimizu | C23C 4/06 428/836.1 |
| 2018/0073117 | A1 * | 3/2018 | Urata | C22C 45/02 |
| 2018/0090251 | A1 * | 3/2018 | Kudo | H01F 1/15308 |
| 2019/0156975 | A1 * | 5/2019 | Urata | B22F 1/0059 |

FOREIGN PATENT DOCUMENTS

| | | | | |
|---|---|---|---|---|
| JP | H07-268566 | A | 10/1995 | |
| JP | H09-213514 | A | 8/1997 | |
| JP | 2000-144349 | A | 5/2000 | |
| JP | 3342767 | B2 | 11/2002 | |
| JP | 2011-195936 | A | 10/2011 | |
| WO | WO-2011024580 | A1 * | 3/2011 | C22C 45/02 |

* cited by examiner

SOFT MAGNETIC ALLOY AND MAGNETIC DEVICE

BACKGROUND OF THE INVENTION

1. Field of the Invention

The present invention relates to a soft magnetic alloy and a magnetic device.

2. Description of the Related Art

Recently, for electronic, information, and communication devices, lower power consumption and higher efficiency are demanded. Further, in order to achieve a low-carbon society, such demands are even more demanded. Thus, a reduction of an energy loss and an improvement of power supply efficiency are demanded for a power circuit of electronic, information and communication devices as well. Further, for a magnetic core of a magnetic element used for the power supply circuit, an improvement of a saturation magnetic flux density, a reduction of a core loss, and an improvement of a magnetic permeability are demanded. When the core loss is reduced, the loss of the electric energy is smaller, and when the magnetic permeability is improved, the magnetic element can be downsized, hence a higher efficiency can be attained and energy can be saved.

Patent document 1 discloses a Fe—B-M (M=Ti, Zr, Hf, V, Nb, Ta, Mo, W) based soft magnetic amorphous alloy. This soft magnetic amorphous alloy exhibits good soft magnetic properties such as a high saturation magnetic flux density or so compared to the commercially available Fe-amorphous material.

[Patent document 1] JP Patent No. 3342767

SUMMARY OF THE INVENTION

Note that, as a method for reducing the core loss of the above mentioned magnetic core, a reduction of a coercivity of the magnetic material constituting the magnetic core is considered.

However, the alloy composition of the patent document 1 is extremely difficult to produce in an air atmosphere because an element to improve the corrosion resistance is not included. Further, even if the alloy composition of the patent document 1 is produced under the nitrogen atmosphere or argon atmosphere by a water atomization method or a gas atomization method, the alloy composition is oxidized even by a small amount of oxygen in the atmosphere.

Also, the patent document 1 discloses that the alloy composition of patent document 1 can improve the soft magnetic property by depositing a fine crystal phase. However, a composition capable of stably depositing the fine crystal phase has not been thoroughly studied.

The present inventors have carried out keen study regarding the composition capable of stably depositing the fine crystal phase. As a result, they have found that the composition different from that disclosed in the patent document 1 can stably deposit the fine crystalline phase.

The object of the present invention is to provide the soft magnetic alloy or so which simultaneously satisfies a high saturation magnetic flux density, a low coercivity, and a high magnetic permeability, further having a high corrosion resistance.

In order to attain the above mentioned object, the soft magnetic alloy according to the present invention comprises a main component having a compositional formula of $((Fe_{(1-(\alpha+\beta))}X1_{\alpha}X2_{\beta})_{1-(a+b+c)}M_aB_bCr_c)_{1-d}C_d$, and a sub component including at least P, S and Ti, wherein X1 is one or more selected from the group consisting Co and Ni, X2 is one or more selected from the group consisting of Al, Mn, Ag, Zn, Sn, As, Sb, Bi, and rare earth elements, "M" is one or more selected from the group consisting of Nb, Hf, Zr, Ta, Mo, W, and V, $0.030 \le a \le 0.14$, $0.005 \le b \le 0.20$, $0 < c \le 0.040$, $0 \le d \le 0.040$, $\alpha \ge 0$, $\beta \ge 0$, and $0 \le \alpha+\beta \le 0.50$ are satisfied, when entire said soft magnetic alloy is 100 wt %, a content of said P is 0.001 to 0.050 wt %, a content of said S is 0.001 to 0.050 wt %, and a content of said Ti is 0.001 to 0.080 wt %, and when a value obtained by dividing the content of said P by the content of said S is P/S, then P/S satisfies $0.10 \le P/S \le 10$.

The above mentioned soft magnetic alloy according to the present invention tends to easily have the Fe-based nanocrystal alloy by carrying out a heat treatment. Further, the above mentioned Fe-based nanocrystal alloy has a high saturation magnetic flux density, a low coercivity, and a high magnetic permeability, thus a soft magnetic alloy having preferable soft magnetic properties is obtained. Furthermore, the soft magnetic alloy has a high corrosion resistance.

The soft magnetic alloy according to the present invention may satisfy $0.73 \le 1-(a+b+c) \le 0.93$.

The soft magnetic alloy according to the present invention may satisfy $0 \le \alpha\{1-(a+b+c\}(1-d) \le 0.40$.

The soft magnetic alloy according to the present invention may satisfy $\alpha=0$.

The soft magnetic alloy according to the present invention may satisfy $0\beta\{1-(a+b+c)\}(1-d) \le 0.030$.

The soft magnetic alloy according to the present invention may satisfy $\beta=0$.

The soft magnetic alloy according to the present invention may satisfy $\alpha=\beta=0$.

The soft magnetic alloy according to the present invention may comprise a nanohetero structure composed of an amorphous phase and initial fine crystals, and said initial fine crystals exist in said amorphous phase.

The soft magnetic alloy according to the present invention may have the initial fine crystals having an average grain size of 0.3 to 10 nm.

The soft magnetic alloy according to the present invention may have a structure composed of Fe-based nanocrystals.

The soft magnetic alloy according to the present invention may have the Fe-based nanocrystals having an average grain size of 5 to 30 nm.

The soft magnetic alloy according to the present invention may be formed in a ribbon form.

The soft magnetic alloy according to the present invention may be formed in a powder form.

Also, the magnetic device according to the present invention is made of the above mentioned soft magnetic alloy.

DESCRIPTION OF THE PREFERRED EMBODIMENTS

Hereinafter, an embodiment of the present invention will be described.

The soft magnetic alloy according to the present embodiment has a main component having a compositional formula of $((Fe_{(1-(\alpha+\beta))}X1_{\alpha}X2_{\beta})_{(1-(a+b+c))}M_aB_bCr_c)_{1-d}C_d$, and a sub component including at least P, S and Ti, wherein X1 is one or more selected from the group consisting Co and Ni, X2 is one or more selected from the group consisting of Al, Mn, Ag, Zn, Sn, As, Sb, Bi, and rare earth elements, "M" is one or more selected from the group consisting of Nb, Hf, Zr, Ta, Mo, W, and V, $0.030 \leq a \leq 0.14$, $0.005 \leq b \leq 0.20$, $0 < c \leq 0.040$, $0 \leq d \leq 0.040$, $\alpha \geq 0$, $\beta \geq 0$, and $0 \leq \alpha+\beta \leq 0.50$ are satisfied, when entire said soft magnetic alloy is 100 wt %, a content of said P is 0.001 to 0.050 wt %, a content of said S is 0.001 to 0.050 wt %, and a content of said Ti is 0.001 to 0.080 wt %, and when a value obtained by dividing the content of said P by the content of said S is P/S, then P/S satisfies $0.10 \leq P/S \leq 10$.

The soft magnetic alloy having the above mentioned composition tends to easily be the soft magnetic alloy composed of the amorphous phase, and not including the crystal phase having a crystal of grain size larger than 30 nm. Further, when heat treating the soft magnetic alloy, the Fe-based nanocrystals are easily deposited. Further, the soft magnetic alloy including Fe-based nanocrystals tends to have good magnetic properties.

In other words, the soft magnetic alloy having the above mentioned composition tends to be a starting material of the soft magnetic alloy deposited with the Fe-based nanocrystals.

The Fe-based nanocrystals are the crystals having the grain size of nano-order, and the crystal structure of Fe is bcc (body-centered cubic structure). In the present embodiment, the Fe-based nanocrystals having the average grain size of 5 to 30 nm are preferably deposited. The soft magnetic alloy deposited with such Fe-based nanocrystals tends to have increased saturation magnetic flux density, and decreased coercivity.

Note that, the soft magnetic alloy prior to the heat treatment may be completely formed only by the amorphous phase, but preferably comprises the nanohetero structure which is formed of the amorphous phase and the initial fine crystals having the grain size of 15 nm or less, and the initial fine crystals exist in the amorphous phase. By having the nanohetero structure of which the initial crystals exist in the amorphous phase, the Fe-based nanocrystals can be easily deposited during the heat treatment. Note that, in the present embodiment, the initial fine crystals preferably have the average grain size of 0.3 to 10 nm.

Hereinafter, each components of the soft magnetic alloy according to the present embodiment will be described in detail.

"M" is one or more elements selected from the group consisting of Nb, Hf, Zr, Ta, Mo, W, and V. "M" is preferably one or more elements selected from a group consisting of Nb, Hf, and Zr. When "M" is one or more elements selected from the group consisting of Nb, Hf, and Zr, the crystal phase having a crystal larger than the grain size of 30 nm will be formed even less in the soft magnetic alloy before the heat treatment.

The content (a) of "M" satisfies $0.030 \leq a \leq 0.14$. The content of "M" is preferably $0.030 \leq a \leq 0.070$, and more preferably $0.030 \leq a \leq 0.050$. If (a) is too small, the crystal phase having a crystal larger than the grain size of 30 nm is easily formed in the soft magnetic alloy before the heat treatment, thus Fe-based nanocrystals cannot be deposited by the heat treatment, and the coercivity tends to easily increase. If (a) is too large, the saturation magnetic flux density tends to easily decrease.

The content (b) of B satisfies $0.005 \leq b \leq 0.20$. Also, preferably it is $0.005 \leq b \leq 0.10$, and more preferably $0.005 \leq b \leq 0.050$. If (b) is too small, the crystal phase having a crystal larger than the grain size of 30 nm is easily formed in the soft magnetic alloy before the heat treatment, thus Fe-based nanocrystals cannot be deposited by the heat treatment, and the coercivity tends to easily increase. If (b) is too large, the saturation magnetic flux density tends to easily decrease. Also, in case the crystal phase having a crystal larger than the grain size of 30 nm is not formed in the soft magnetic alloy before the heat treatment; the smaller the (b) is, the soft magnetic alloy after the heat treatment tends to simultaneously satisfy a high saturation magnetic flux density, a low coercivity, and a high magnetic permeability.

The content $(1-(a+b+c))$ of Fe is not particularly limited, but preferably it satisfies $0.73 \leq 1-(a+b+c) \leq 0.93$. When the content $(1-(a+b+c))$ of Fe is $0.73 \leq 1-(a+b+c)$, the saturation magnetic flux density can be easily improved. Also, when the content $(1-(a+b+c))$ of Fe is $1-(a+b+c) \leq 0.93$, the amorphous phase having a nanohetero structure tends to be easily formed to the soft magnetic alloy before heat treating, wherein the nanohetero structure is composed of the amorphous phase and the initial fine crystals having the average grain size of 15 nm or less, and the initial fine crystals exist in the amorphous phase. Also, when the content $(1-(a+b+c))$ of Fe is $1-(a+b+c) \leq 0.93$, the crystal phase having a crystal larger than the grain size of 30 nm will be scarcely formed in the soft magnetic alloy before the heat treatment.

The content (c) of Cr satisfies $0 < c \leq 0.040$. The content (c) of Cr is preferably $0.001 \leq c \leq 0.040$, and more preferably $0.005 \leq c \leq 0.040$. If (c) is too large, the saturation magnetic flux density tends to decrease. If (c) is too small, or if Cr is not included, the corrosion resistance tends to decrease.

The content (d) of C satisfies $0 \leq d \leq 0.040$. It also may be $d=0$. That is, C may not be included. By including C, the coercivity tends to easily decrease. The content (d) of C is preferably $0.001 \leq d \leq 0.040$, and more preferably $0.005 \leq d \leq 0.040$. If (d) is too large, the crystal phase having a crystal larger than the grain size of 30 nm is easily formed in the soft magnetic alloy before the heat treatment, thus the Fe-based nanocrystals cannot be deposited by the heat treatment, and the coercivity tends to easily increase. On the other hand, when C is not included ($d=0$), there is an advantage that the initial fine crystals having the grain size of 15 nm or less is easily formed compared to when C is included.

Also, for the soft magnetic alloy according to the present embodiment, a part of Fe may be substituted with X1 and/or X2.

X1 is one or more elements selected from a group consisting of Co and Ni. The content ($\alpha$) of X1 may be $\alpha=0$. That is, X1 may not be included. Also, the number of atoms of X1 is preferably 40 at % or less with respect to 100 at % of the number of atoms of the entire composition. That is, $0 \leq \alpha\{1-(a+b+c)\}(1-d) \leq 0.40$ is preferably satisfied.

X2 is one or more elements selected from the group consisting of Al, Mn, Ag, Zn, Sn, As, Sb, Bi, and rare earth elements. The content (β) of X2 may be β=0. That is, X2 may not be included. Also, the number of atoms of X2 is preferably 3.0 at % or less with respect to 100 at % of the number of atoms of the entire composition. That is, $0 \leq \beta\{1-(a+b+c)\}(1-d) \leq 0.030$ may be satisfied.

The range of the substitution amount of Fe with X1 and/or X2 is half or less of Fe based on the number of atoms. That is, $0 \leq \alpha+\beta \leq 0.50$ is satisfied. In case of $\alpha+\beta<0.50$, it may become difficult to obtain the Fe-based nanocrystal alloy by the heat treatment.

Further, the soft magnetic alloy according to the present embodiment includes P, S, and Ti as the subcomponent other than the above mentioned main component. When the entire soft magnetic alloy is 100 wt %, the content of P is 0.001 to 0.050 wt %, the content of S is 0.001 to 0.050 wt %, and the content of Ti is 0.001 to 0.080 wt %. Further, when the value obtained by dividing the content of said P with the content of said S is P/S, then P/S satisfies $0.10 \leq P/S \leq 10$.

As all of P, S, and Ti satisfy the above mentioned contents, the initial fine crystals having the grain size of 15 nm or less are easily formed. As a result, the soft magnetic alloy simultaneously attaining a high saturation magnetic flux density, a low cercivity, and a high magnetic permeability can be obtained. Note that, the above mentioned effects are exhibited by having all of P, S, and Ti at the same time. That is, if any one or more among P, S, and Ti are not included, and particularly when the content (b) of B is $0.005 \leq b \leq 0.050$, the crystal phase having a crystal larger than the grain size of 30 nm is easily formed in the soft magnetic alloy before the heat treatment, thus Fe-based nanocrystals cannot be deposited by the heat treatment, and the coercivity tends to easily increase. In other words, if all of P, S, and Ti are included, and when the content (b) of B is $0.005 \leq b \leq 0.050$, the crystal phase having a crystal larger than the grain size of 30 nm will be scarcely formed. Further, as the content of B is small, the content of Fe can be increased, and the soft magnetic alloy simultaneously attaining particularly high saturation magnetic flux density, particularly low cercivity, and particularly high magnetic permeability can be obtained.

Also, any one or more among the content of P, the content of S, the content of Ti, and P/S are out of the above mentioned range, the coercivity tends to easily increase, and the magnetic permeability tends to easily decrease. Also, if the content of P is too small, the corrosion resistance tends to decrease.

The content of P is preferably 0.005 wt % or more and 0.040 wt % or less. The content of S is 0.005 wt % or more and 0.040 wt % or less. The content of Ti is preferably 0.010 wt % or more and 0.040 wt % or less. When the contents of P, S, and/or Ti are within the above mentioned range, particularly the magnetic permeability tends to improve.

Note that, the soft magnetic alloy according to the present embodiment may include an element other than the main component and the subcomponents as an inevitable impurity. For example, 0.1 wt % or less may be included with respect to 100 wt % of the soft magnetic alloy.

Hereinafter, the method of producing the soft magnetic alloy according to the present embodiment will be described.

The method of producing the soft magnetic alloy according to the present embodiment is not particularly limited. For example, the method of producing a ribbon of the soft magnetic alloy according to the present embodiment by a single roll method may be mentioned. The ribbon may be a continuous ribbon.

As the single roll method, pure metals of each metal element which will be included in the soft magnetic alloy at the end are prepared, then these are weighed so that the same composition as the soft magnetic alloy obtained at the end is obtained. Then, the pure metals of each metal element are melted and mixed, thereby a base alloy is produced. Note that, the method of melting said pure metals is not particularly limited, and for example, the method of vacuuming inside the chamber, and then melting by a high-frequency heating may be mentioned. Note that, the base alloy and the soft magnetic alloy composed of the Fe-based nanocrystals obtained at the end usually has the same composition.

Next, the produced base alloy is heated and melted, thereby a molten metal is obtained. The temperature of the molten metal is not particularly limited, and for example it may be 1200 to 1500° C.

For the single roll method, the thickness of the ribbon to be obtained can be regulated mainly by regulating a rotating speed of a roll. However, the thickness of the ribbon to be obtained can be regulated also by regulating the space between a nozzle and a roll, and the temperature of the molten metal. The thickness of the ribbon is not particularly limited, but for example a thickness is 5 to 30 μm.

Prior to the heat treatment which will be described in below, the ribbon is the amorphous phase which does not include a crystal having the grain size larger than 30 nm. By carrying out the heat treatment which will be described in below to the ribbon of amorphous phase, the Fe-based nanocrystal alloy can be obtained.

Note that, the method of verifying the presence of the crystal having the grain size larger than 30 nm in the ribbon of the soft magnetic alloy before the heat treatment is not particularly limited. For example, the crystal having the grain size larger than 30 nm can be verified by a usual X-ray diffraction measurement.

Also, in the ribbon before the heat treatment, the initial fine crystal having the grain size of 15 nm or less may not be included at all, but preferably the initial fine crystal is included. That is, the ribbon before the heat treatment is preferably a nanohetero structure composed of the amorphous phase and the initial fine crystals present in the amorphous phase. Note that, the grain size of the initial fine crystal is not particularly limited, and preferably the average grain size is 0.3 to 10 nm.

Also, the method of verifying the average grain size and the presence of the above mentioned initial fine crystals are not particularly limited, and for example these may be verified by obtaining a restricted visual field diffraction image, a nano beam diffraction image, a bright field image, or a high resolution image using a transmission electron microscope to the sample thinned by ion milling or so. When using the restricted visual field diffraction image or the nano beam diffraction image, as the diffraction pattern, a ring form diffraction is formed in case of the amorphous phase, on the other hand a diffraction spots are formed which is caused by the crystal structure when it is not an amorphous phase. Also, when using the bright field image or the high resolution image, by visually observing at the magnification of $1.00 \times 10^5$ to $3.00 \times 10^5$, the presence of the initial fine crystals and the average grain size can be verified.

The temperature and the rotating speed of the roll and the atmosphere inside the chamber are not particularly limited. The temperature of the roll is preferably 4 to 30° C. for the amorphization. The faster the rotating speed of the roll is, the smaller the average grain size of the initial fine crystals tends to be. The rotating speed is preferably 25 to 30 m/sec from the point of obtaining the initial fine crystals having the average grain size of 0.3 to 10 nm. The atmosphere inside of the chamber is preferably air atmosphere considering the cost.

Also, the heat treating condition for producing the Fe-based nanocrystal alloy is not particularly limited. The more preferable heat treating condition differs depending on the composition of the soft magnetic alloy. Usually, the preferable heat treating condition is about 400 to 600° C., and preferable heat treating time is about 0.5 to 10 hours. However, depending on the composition, the preferable heat treating temperature and the heat treating time may be outside of the above mentioned ranges. Also, the atmosphere of the heat treatment is not particularly limited. The heat treatment may be carried out under active atmosphere such as air atmosphere, or under inert atmosphere such as Ar gas.

Also, the method of calculating the average grain size of the obtained Fe-based nanocrystal alloy is not particularly limited. For example, it can be calculated by an observation using a transmission electron microscope. Also, the method of verifying the crystal structure of bcc (body-centered cubic structure) is not particularly limited. For example, this can be verified using X-ray diffraction measurement.

Also, as the method of obtaining the soft magnetic alloy according to the present embodiment, besides the above mentioned single roll method, for example the method of obtaining the powder of the soft magnetic alloy according to the present embodiment by a water atomizing method or a gas atomizing method may be mentioned. Hereinafter, the gas atomizing method will be described.

In the gas atomizing method, the molten alloy having the temperature of 1200 to 1500° C. is obtained by the same method as the above mentioned single roll method. Then, said molten metal is sprayed in the chamber, thereby the powder is produced.

Here, the gas spray temperature is 4 to 30° C., and the vapor pressure inside the chamber is 1 hPa or less, thereby the above mentioned preferable hetero structure can be easily obtained.

After producing the powder using the gas atomizing method, by carrying out the heat treatment under the condition of 400 to 600° C. for 0.5 to 10 minutes, the diffusion of elements are facilitated while the powder is prevented from becoming a coarse powder due to the sintering of the powders with each other, a thermodynamic equilibrium can be attained in a short period of time, and a distortion or stress can be removed, thus the Fe-based soft magnetic alloy having the average grain size of 5 to 30 nm can be easily obtained.

Hereinabove, an embodiment of the present invention has been described, but the present invention is not to be limited to the above mentioned embodiment.

The shape of the soft magnetic alloy according to the present embodiment is not particularly limited. As mentioned in above, a ribbon form and a powder form may be mentioned as examples, but besides these, a thin film form and a block form or so may be mentioned as well.

The use of the soft magnetic alloy (the Fe-based nanocrystal alloy) according to the present embodiment is not particularly limited. For example, magnetic devices may be mentioned, and among these, particularly the magnetic cores may be mentioned. It can be suitably used as the magnetic core for inductors, particularly power inductors. The soft magnetic alloy according to the present embodiment can be suitably used for thin film inductors, and magnetic heads or so other than the magnetic cores.

Hereinafter, the method of obtaining the magnetic devices, particularly the magnetic core and the inductor from the soft magnetic alloy according to the present embodiment will be described, but the method of obtaining the magnetic devices, particularly the magnetic core and the inductor from the soft magnetic alloy according to the present embodiment is not limited thereto. Also, as the use of the magnetic core, transformers and motors or so may be mentioned besides the inductor.

As the method of obtaining the magnetic core from the soft magnetic alloy of the ribbon form, the method of laminating or winding the soft magnetic alloy of a ribbon form may be mentioned. In case of laminating the ribbon form soft magnetic alloy via an insulator, the magnetic core with even enhanced properties can be obtained.

As the method of obtaining the magnetic core from the powder form soft magnetic alloy, for example the method of mixing with the binder appropriately and then molding may be mentioned. Also, before mixing with the binder, by carrying out the oxidation treatment or an insulation coating to the powder surface, the specific resistance is improved and the magnetic core suitable for even higher frequency regions is obtained.

The method of molding is not particularly limited, and the molding and the mold pressing or so may be mentioned. The type of binder is not particularly limited, and silicone resin may be mentioned as example. The mixing ratio between the soft magnetic alloy powder and the binder is not particularly limited. For example, 1 to 10 mass % of the binder is mixed with respect to 100 mass % of the soft magnetic alloy powder.

For example, 1 to 5 mass % of binder is mixed with respect to 100 mass % of the soft magnetic alloy powder, then a compression molding is carried out, thereby the magnetic core having 70% or more of a space factor (a powder filling rate), and a magnetic flux density of 0.45 T or more and the specific resistance of 1 Ω·cm or more when applied with a magnetic field of $1.6\times10^4$ A/m can be obtained. The above mentioned properties are the properties same or more than the general ferrite magnetic core.

Also, for example, by mixing 1 to 3 mass % of the binder with respect to 100 mass % of the soft magnetic alloy powder, and carrying out the compression molding under the temperature at the softening point or higher of the binder, the dust core having 80% or more of a space factor, and a magnetic flux density of 0.9 T or more and the specific resistance of 0.1 Ω·cm or more when applied with a magnetic field of $1.6\times10^4$ A/m can be obtained. The above mentioned properties are excellent properties compared to the general dust core.

Further, by carrying out the heat treatment after the molding as a heat treatment for removing the distortion to the powder compact which forms the above mentioned magnetic core, the core loss is further decreased, and becomes even more useful. Note that, the core loss of the magnetic core decreases as the coercivity of the magnetic material constituting the magnetic core decreases.

Also, the inductance product is obtained by winding a wire around the above mentioned magnetic core. The method of winding the wire and the method of producing the inductance product are not particularly limited. For example, the method of winding at least 1 or more turns of wire around the magnetic core produced by the above mentioned method may be mentioned.

Further, in case of using the soft magnetic alloy particle, the method of press molding while the wire is incorporated in the magnetic material to integrate the wire and the magnetic material, thereby producing the inductance product may be mentioned. In this case, the inductance product corresponding to a high frequency and a large current is easily obtained.

Further, in case of using the soft magnetic alloy particle, a soft magnetic alloy paste which is made into a paste by adding the binder and a solvent to the soft magnetic alloy particle, and a conductor paste which is made into a paste by adding the binder and a solvent to a conductor metal for the coil are print laminated in an alternating manner, and fired; thereby the inductance product can be obtained. Alternatively, the soft magnetic alloy sheet is produced using the soft magnetic alloy paste, and the conductor paste is printed on the surface of the soft magnetic alloy sheet, then these are laminated and fired, thereby the inductance product of which the coil being incorporated in the magnetic material can be obtained.

Here, in case of producing the inductance product using the soft magnetic alloy particle, in order to obtain an excellent Q property, the soft magnetic alloy powder having a maximum particle size of 45 μm or less by sieve diameter and a center particle size (D50) of 30 μm or less is preferably used. In order to have a maximum particle size of 45 μm or less by a sieve diameter, by using a sieve with a mesh size of 45 μm, only the soft magnetic alloy powder which passes through the sieve may be used.

The larger the maximum particle size of the used soft magnetic alloy powder is, the lower the Q value tends to be in a high frequency range, and in case of using the soft magnetic alloy powder of which the maximum particle size exceeds 45 μm by a sieve diameter, the Q value may greatly decrease in the high frequency range. However, if the Q value in the high frequency range is not important, the soft magnetic alloy powder having a large size variation can be used. The soft magnetic alloy powder with large size variation can be produced at relatively low cost, therefore in case of using the soft magnetic alloy powder having a large size variation, the cost can be reduced.

EXAMPLE

Hereinafter, the present invention will be described based on examples.

Metal materials were weighed so that the alloy compositions of each examples and comparative examples shown in below were satisfied, then melted by a high-frequency heating, thereby the base alloy was prepared.

Then, the prepared base alloy was heated and melted to obtain the molten metal at 1300° C., then said metal was sprayed to a roll by a single roll method which was used in the air atmosphere at 20° C. and rotating speed of 30 m/sec. Thereby, ribbons were formed. The ribbon had a thickness of 20 to 25 μm, the width of about 15 mm, and the length of about 10 m.

The X-ray diffraction measurement was carried out to obtain each ribbon to verify the presence of the crystals having the grain size larger than 30 nm. If the crystal having the grain size larger than 30 nm did not exist, then it was determined to be formed by the amorphous phase, and if crystals having the grain size larger than 30 nm did exist, then it was determined to be formed by the crystal phase. Note that, the amorphous phase may include the initial fine crystals having the grain size of 15 nm or less.

Then, the heat treatment was carried out by the condition shown in below to the ribbon of each examples and comparative examples. After the heat treatment was carried out to each ribbon, the saturation magnetic flux density, the coercivity, and the magnetic permeability were measured. The saturation magnetic flux density (Bs) was measured using a vibrating sample magnetometer (VSM) in a magnetic field of 1000 kA/m. The coercivity (Hc) was measured using a DC-BH tracer in a magnetic field of 5 kA/m. The magnetic permeability (μ') was measured using an impedance analyzer in a frequency of 1 kHz. In the present examples, the saturation magnetic flux density of 1.30 T or more was considered to be favorable, and the saturation magnetic flux density of 1.40 T or more was considered to be more favorable, and the saturation magnetic flux density of 1.55 T or more was considered to be most favorable. In the present examples, the coercivity of 3.0 A/m or less was considered to be favorable, the coercivity of 2.4 A/m or less was considered to be more favorable, and the coercivity of 2.0 A/m or less was considered to be the most favorable. The magnetic permeability of 49000 or more was considered favorable, 52000 or more was considered more favorable, and 54000 or more was considered the most favorable.

Further, a constant temperature and humidity test was carried out to the ribbon of each example and comparative example to evaluate the corrosion resistance. The time of withstanding the corrosion under the condition of the temperature of 80° C. and the humidity of 85% RH was observed. For the present examples, 40 hours or more was considered good.

Note that, in the examples shown in below, unless mentioned otherwise, the observation using an X-ray diffraction measurement and a transmission electron microscope verified that all examples shown in below had Fe-based nanocrystals having the average grain size of 5 to 30 nm and the crystal structure of bcc.

TABLE 1

| | $(Fe_{(1-(a+b+c))}M_aB_bCr_c)_{1-d}C_d$ ($\alpha = \beta = 0$) | | | | | | | | | | | | | | | |
|---|---|---|---|---|---|---|---|---|---|---|---|---|---|---|---|---|
| Sample No. | Fe | Nb | Hf a | Zr | B b | Cr c | C d | P (wt %) | S (wt %) | P/S | Ti (wt %) | XRD | Constant temperature and humidity test 80° C. × 85 RH/h (h) | Bs (T) | Hc (A/m) | μ' (1 kHz) |
| Example 1 | 0.850 | 0.030 | 0.000 | 0.000 | 0.100 | 0.020 | 0.000 | 0.001 | 0.001 | 1.00 | 0.001 | amorphous phase | 78 | 1.47 | 2.0 | 52300 |
| Example 2 | 0.810 | 0.070 | 0.000 | 0.000 | 0.100 | 0.020 | 0.000 | 0.001 | 0.001 | 1.00 | 0.001 | amorphous phase | 80 | 1.40 | 2.5 | 51800 |
| Example 3 | 0.740 | 0.140 | 0.000 | 0.000 | 0.100 | 0.020 | 0.000 | 0.001 | 0.001 | 1.00 | 0.001 | amorphous phase | 80 | 1.38 | 2.7 | 51400 |

TABLE 1-continued

| | $(Fe_{(1-(a+b+c))}M_aB_bCr_c)_{1-d}C_d$ ($\alpha = \beta = 0$) | | | | | | | | | | | | | | | |
|---|---|---|---|---|---|---|---|---|---|---|---|---|---|---|---|---|
| Sample No. | Fe | Nb | Hf a | Zr | B b | Cr c | C d | P (wt %) | S (wt %) | P/S | Ti (wt %) | XRD | Constant temperature and humidity test 80° C. × 85 RH/h (h) | Bs (T) | Hc (A/m) | μ' (1 kHz) |
| Example 4 | 0.905 | 0.070 | 0.000 | 0.000 | 0.005 | 0.020 | 0.000 | 0.001 | 0.001 | 1.00 | 0.001 | amorphous phase | 75 | 1.69 | 2.0 | 53000 |
| Example 5 | 0.710 | 0.070 | 0.000 | 0.000 | 0.200 | 0.020 | 0.000 | 0.001 | 0.001 | 1.00 | 0.001 | amorphous phase | 82 | 1.29 | 2.8 | 50200 |
| Example 6 | 0.829 | 0.070 | 0.000 | 0.000 | 0.100 | 0.001 | 0.000 | 0.001 | 0.001 | 1.00 | 0.001 | amorphous phase | 80 | 1.44 | 2.7 | 50500 |
| Example 7 | 0.790 | 0.070 | 0.000 | 0.000 | 0.100 | 0.040 | 0.000 | 0.001 | 0.001 | 1.00 | 0.001 | amorphous phase | 86 | 1.38 | 2.2 | 52000 |
| Example 8 | 0.850 | 0.030 | 0.000 | 0.000 | 0.100 | 0.020 | 0.000 | 0.010 | 0.010 | 1.00 | 0.010 | amorphous phase | 84 | 1.50 | 2.2 | 53400 |
| Example 9 | 0.810 | 0.070 | 0.000 | 0.000 | 0.100 | 0.020 | 0.000 | 0.010 | 0.010 | 1.00 | 0.010 | amorphous phase | 86 | 1.46 | 2.4 | 52900 |
| Example 10 | 0.740 | 0.140 | 0.000 | 0.000 | 0.100 | 0.020 | 0.000 | 0.010 | 0.010 | 1.00 | 0.010 | amorphous phase | 86 | 1.36 | 2.8 | 50800 |
| Example 11 | 0.905 | 0.070 | 0.000 | 0.000 | 0.005 | 0.020 | 0.000 | 0.010 | 0.010 | 1.00 | 0.010 | amorphous phase | 81 | 1.71 | 2.1 | 54300 |
| Example 12 | 0.710 | 0.070 | 0.000 | 0.000 | 0.200 | 0.020 | 0.000 | 0.010 | 0.010 | 1.00 | 0.010 | amorphous phase | 87 | 1.30 | 2.7 | 50100 |
| Example 13 | 0.829 | 0.070 | 0.000 | 0.000 | 0.100 | 0.001 | 0.000 | 0.010 | 0.010 | 1.00 | 0.010 | amorphous phase | 85 | 1.47 | 2.8 | 50300 |
| Example 14 | 0.790 | 0.070 | 0.000 | 0.000 | 0.100 | 0.040 | 0.000 | 0.010 | 0.010 | 1.00 | 0.010 | amorphous phase | 88 | 1.39 | 2.3 | 53200 |
| Example 15 | 0.850 | 0.030 | 0.000 | 0.000 | 0.100 | 0.020 | 0.000 | 0.050 | 0.050 | 1.00 | 0.050 | amorphous phase | 83 | 1.46 | 2.3 | 53200 |
| Example 16 | 0.810 | 0.070 | 0.000 | 0.000 | 0.100 | 0.020 | 0.000 | 0.050 | 0.050 | 1.00 | 0.050 | amorphous phase | 85 | 1.40 | 2.6 | 52500 |
| Example 17 | 0.740 | 0.140 | 0.000 | 0.000 | 0.100 | 0.020 | 0.000 | 0.050 | 0.050 | 1.00 | 0.050 | amorphous phase | 85 | 1.35 | 2.6 | 52100 |
| Example 18 | 0.905 | 0.070 | 0.000 | 0.000 | 0.005 | 0.020 | 0.000 | 0.050 | 0.050 | 1.00 | 0.050 | amorphous phase | 78 | 1.70 | 2.1 | 54700 |
| Example 19 | 0.710 | 0.070 | 0.000 | 0.000 | 0.200 | 0.020 | 0.000 | 0.050 | 0.050 | 1.00 | 0.050 | amorphous phase | 87 | 1.26 | 2.7 | 50500 |
| Example 20 | 0.829 | 0.070 | 0.000 | 0.000 | 0.100 | 0.001 | 0.000 | 0.050 | 0.050 | 1.00 | 0.050 | amorphous phase | 85 | 1.46 | 2.8 | 50200 |
| Example 21 | 0.790 | 0.070 | 0.000 | 0.000 | 0.100 | 0.040 | 0.000 | 0.050 | 0.050 | 1.00 | 0.050 | amorphous phase | 89 | 1.37 | 2.4 | 52800 |

TABLE 2

| | $(Fe_{(1-(a+b+c))}M_aB_bCr_c)_{1-d}C_d$ ($\alpha = \beta = 0$) | | | | | | | |
|---|---|---|---|---|---|---|---|---|
| Sample No. | Fe | Nb | Hf a | Zr | B b | Cr c | C d | P (wt %) |
| Comparative example 1 | 0.850 | 0.030 | 0.000 | 0.000 | 0.100 | 0.020 | 0.000 | ***0.000*** |
| Comparative example 2 | 0.810 | 0.070 | 0.000 | 0.000 | 0.100 | 0.020 | 0.000 | ***0.000*** |
| Comparative example 3 | 0.740 | 0.140 | 0.000 | 0.000 | 0.100 | 0.020 | 0.000 | ***0.000*** |
| Comparative example 4 | 0.905 | 0.070 | 0.000 | 0.000 | 0.005 | 0.020 | 0.000 | ***0.000*** |
| Comparative example 5 | 0.710 | 0.070 | 0.000 | 0.000 | 0.200 | 0.020 | 0.000 | ***0.000*** |
| Comparative example 6 | 0.829 | 0.070 | 0.000 | 0.000 | 0.100 | 0.001 | 0.000 | ***0.000*** |
| Comparative example 7 | 0.790 | 0.070 | 0.000 | 0.000 | 0.100 | 0.040 | 0.000 | ***0.000*** |
| Comparative example 8 | 0.810 | 0.070 | 0.000 | 0.000 | 0.100 | 0.020 | 0.000 | 0.001 |
| Comparative example 9 | 0.810 | 0.070 | 0.000 | 0.000 | 0.100 | 0.020 | 0.000 | 0.050 |
| Comparative example 10 | 0.810 | 0.070 | 0.000 | 0.000 | 0.100 | 0.020 | 0.000 | ***0.000*** |
| Comparative example 11 | 0.810 | 0.070 | 0.000 | 0.000 | 0.100 | 0.020 | 0.000 | ***0.000*** |

TABLE 2-continued

| | | | | | | | | |
|---|---|---|---|---|---|---|---|---|
| Comparative example 12 | 0.810 | 0.070 | 0.000 | 0.000 | 0.100 | 0.020 | 0.000 | ***0.000*** |
| Comparative example 13 | 0.810 | 0.070 | 0.000 | 0.000 | 0.100 | 0.020 | 0.000 | ***0.000*** |
| Comparative example 14 | 0.810 | 0.070 | 0.000 | 0.000 | 0.100 | 0.020 | 0.000 | 0.001 |
| Comparative example 15 | 0.810 | 0.070 | 0.000 | 0.000 | 0.100 | 0.020 | 0.000 | 0.050 |
| Comparative example 16 | 0.810 | 0.070 | 0.000 | 0.000 | 0.100 | 0.020 | 0.000 | ***0.000*** |
| Comparative example 17 | 0.810 | 0.070 | 0.000 | 0.000 | 0.100 | 0.020 | 0.000 | ***0.000*** |
| Comparative example 18 | 0.810 | 0.070 | 0.000 | 0.000 | 0.100 | 0.020 | 0.000 | 0.001 |
| Comparative example 19 | 0.810 | 0.070 | 0.000 | 0.000 | 0.100 | 0.020 | 0.000 | 0.050 |
| Comparative example 20 | 0.925 | 0.060 | 0.000 | 0.000 | 0.005 | 0.010 | 0.000 | 0.010 |
| Comparative example 21 | 0.925 | 0.060 | 0.000 | 0.000 | 0.005 | 0.010 | 0.000 | ***0.000*** |
| Comparative example 22 | 0.925 | 0.060 | 0.000 | 0.000 | 0.005 | 0.010 | 0.000 | ***0.000*** |
| Example 22 | 0.925 | 0.060 | 0.000 | 0.000 | 0.005 | 0.010 | 0.000 | 0.010 |

| | $(Fe_{(l-(a+b+c))}M_aB_bCr_c)_{1-d}C_d$ ($\alpha = \beta = 0$) | | | | | | | |
|---|---|---|---|---|---|---|---|---|
| Sample No. | S (wt %) | P/S | Ti (wt %) | XRD | Constant temperature and humidity test 80° C. × 85 RH/h (h) | Bs (T) | Hc (A/m) | μ' (1 kHz) |
| Comparative example 1 | ***0.000*** | — | ***0.000*** | amorphous phase | ***17*** | 1.48 | ***6.4*** | ***33500*** |
| Comparative example 2 | ***0.000*** | — | ***0.000*** | amorphous phase | ***30*** | 1.41 | ***7.3*** | ***33200*** |
| Comparative example 3 | ***0.000*** | — | ***0.000*** | amorphous phase | ***30*** | 1.37 | ***7.0*** | ***31300*** |
| Comparative example 4 | ***0.000*** | — | ***0.000*** | ***crystal phase*** | ***26*** | 1.66 | ***281*** | ***516*** |
| Comparative example 5 | ***0.000*** | — | ***0.000*** | amorphous phase | ***30*** | 1.34 | ***6.5*** | ***31000*** |
| Comparative example 6 | ***0.000*** | — | ***0.000*** | amorphous phase | ***29*** | 1.43 | ***7.5*** | ***30300*** |
| Comparative example 7 | ***0.000*** | — | ***0.000*** | amorphous phase | ***38*** | 1.39 | ***6.1*** | ***34200*** |
| Comparative example 8 | ***0.000*** | — | ***0.000*** | amorphous phase | 61 | 1.39 | ***5.0*** | ***35400*** |
| Comparative example 9 | ***0.000*** | — | ***0.000*** | amorphous phase | 62 | 1.36 | ***4.5*** | ***38000*** |
| Comparative example 10 | 0.001 | ***0.00*** | ***0.000*** | amorphous phase | ***23*** | 1.38 | ***5.6*** | ***35200*** |
| Comparative example 11 | 0.050 | ***0.00*** | ***0.000*** | amorphous phase | ***25*** | 1.36 | ***5.2*** | ***38900*** |
| Comparative example 12 | ***0.000*** | — | 0.001 | amorphous phase | ***23*** | 1.42 | ***5.7*** | ***38600*** |
| Comparative example 13 | ***0.000*** | — | 0.080 | amorphous phase | ***26*** | 1.36 | ***5.2*** | ***36000*** |
| Comparative example 14 | 0.001 | 1.00 | ***0.000*** | amorphous phase | 60 | 1.46 | ***4.1*** | ***40900*** |
| Comparative example 15 | 0.050 | 1.00 | ***0.000*** | amorphous phase | 71 | 1.43 | ***4.0*** | ***43200*** |
| Comparative example 16 | 0.001 | ***0.00*** | 0.001 | amorphous phase | ***24*** | 1.48 | ***4.3*** | ***41200*** |
| Comparative example 17 | 0.050 | ***0.00*** | 0.080 | amorphous phase | ***25*** | 1.46 | ***4.2*** | ***42300*** |
| Comparative example 18 | ***0.000*** | — | 0.001 | amorphous phase | 62 | 1.41 | ***4.5*** | ***43400*** |
| Comparative example 19 | ***0.000*** | — | 0.080 | amorphous phase | 72 | 1.40 | ***4.4*** | ***42600*** |
| Comparative example 20 | ***0.000*** | — | ***0.000*** | ***crystal phase*** | 53 | 1.68 | ***312*** | ***403*** |

TABLE 2-continued

| | | | | | | | | |
|---|---|---|---|---|---|---|---|---|
| Comparative example 21 | 0.010 | — | ***0.000*** | ***crystal phase*** | ***23*** | 1.70 | ***201*** | ***889*** |
| Comparative example 22 | ***0.000*** | — | 0.010 | ***crystal phase*** | ***25*** | 1.65 | ***199*** | ***913*** |
| Example 22 | 0.010 | 1.00 | 0.010 | amorphous phase | 82 | 1.74 | 2.1 | 54100 |

TABLE 3

| | $(Fe_{(1-(a+b+c))}M_aB_bCr_c)_{1-d}C_d$ ($\alpha = \beta = 0$) | | | | | | | |
|---|---|---|---|---|---|---|---|---|
| Sample No. | Fe | Nb | Hf a | Zr | B b | Cr c | C d | P (wt %) |
| Comparative example 23 | 0.860 | ***0.020*** | ***0.000*** | ***0.000*** | 0.100 | 0.020 | 0.000 | 0.010 |
| Example 23 | 0.850 | 0.030 | 0.000 | 0.000 | 0.100 | 0.020 | 0.000 | 0.010 |
| Example 24 | 0.830 | 0.050 | 0.000 | 0.000 | 0.100 | 0.020 | 0.000 | 0.010 |
| Example 25 | 0.810 | 0.070 | 0.000 | 0.000 | 0.100 | 0.020 | 0.000 | 0.010 |
| Example 26 | 0.780 | 0.100 | 0.000 | 0.000 | 0.100 | 0.020 | 0.000 | 0.010 |
| Example 27 | 0.760 | 0.120 | 0.000 | 0.000 | 0.100 | 0.020 | 0.000 | 0.010 |
| Example 28 | 0.740 | 0.140 | 0.000 | 0.000 | 0.100 | 0.020 | 0.000 | 0.010 |
| Comparative example 24 | 0.730 | ***0.150*** | ***0.000*** | ***0.000*** | 0.100 | 0.020 | 0.000 | 0.010 |

| | $(Fe_{(1-(a+b+c))}M_aB_bCr_c)_{1-d}C_d$ ($\alpha = \beta = 0$) | | | | | | | |
|---|---|---|---|---|---|---|---|---|
| Sample No. | S (wt %) | P/S | Ti (wt %) | XRD | Constant temperature and humidity test 80° C. × 85 RH/h (h) | Bs (T) | Hc (A/m) | μ' (1 kHz) |
| Comparative example 23 | 0.005 | 2.00 | 0.010 | ***crystal phase*** | 79 | 1.48 | ***351*** | ***227*** |
| Example 23 | 0.005 | 2.00 | 0.010 | amorphous phase | 83 | 1.51 | 2.1 | 54000 |
| Example 24 | 0.005 | 2.00 | 0.010 | amorphous phase | 83 | 1.49 | 2.2 | 53700 |
| Example 25 | 0.005 | 2.00 | 0.010 | amorphous phase | 83 | 1.45 | 2.4 | 52800 |
| Example 26 | 0.005 | 2.00 | 0.010 | amorphous phase | 83 | 1.42 | 2.5 | 51500 |
| Example 27 | 0.005 | 2.00 | 0.010 | amorphous phase | 84 | 1.40 | 2.7 | 51500 |
| Example 28 | 0.005 | 2.00 | 0.010 | amorphous phase | 84 | 1.35 | 2.9 | 50700 |
| Comparative example 24 | 0.005 | 2.00 | 0.010 | amorphous phase | 87 | ***1.18*** | 3.0 | 50500 |

TABLE 4

| Sample No. | $(Fe_{(1-(a+b+c))}M_aB_bCr_c)_{1-d}C_d$ ($\alpha = \beta = 0$) Fe | Nb | Hf a | Zr | B b | Cr c | C d | P (wt %) |
|---|---|---|---|---|---|---|---|---|
| Example 29 | 0.850 | 0.000 | 0.030 | 0.000 | 0.100 | 0.020 | 0.000 | 0.010 |
| Example 30 | 0.850 | 0.000 | 0.000 | 0.030 | 0.100 | 0.020 | 0.000 | 0.010 |
| Example 31 | 0.810 | 0.000 | 0.070 | 0.000 | 0.100 | 0.020 | 0.000 | 0.010 |
| Example 32 | 0.810 | 0.000 | 0.000 | 0.070 | 0.100 | 0.020 | 0.000 | 0.010 |
| Example 33 | 0.740 | 0.000 | 0.140 | 0.000 | 0.100 | 0.020 | 0.000 | 0.010 |
| Example 34 | 0.740 | 0.000 | 0.000 | 0.140 | 0.100 | 0.020 | 0.000 | 0.010 |
| Example 35 | 0.850 | 0.015 | 0.015 | 0.000 | 0.100 | 0.020 | 0.000 | 0.010 |
| Example 36 | 0.850 | 0.015 | 0.000 | 0.015 | 0.100 | 0.020 | 0.000 | 0.010 |
| Example 37 | 0.850 | 0.000 | 0.015 | 0.015 | 0.100 | 0.020 | 0.000 | 0.010 |
| Example 38 | 0.740 | 0.070 | 0.070 | 0.000 | 0.100 | 0.020 | 0.000 | 0.010 |
| Example 39 | 0.740 | 0.070 | 0.000 | 0.070 | 0.100 | 0.020 | 0.000 | 0.010 |
| Example 40 | 0.740 | 0.000 | 0.070 | 0.070 | 0.100 | 0.020 | 0.000 | 0.010 |
| Example 41 | 0.850 | 0.010 | 0.010 | 0.010 | 0.100 | 0.020 | 0.000 | 0.010 |
| Example 42 | 0.740 | 0.050 | 0.050 | 0.040 | 0.100 | 0.020 | 0.000 | 0.010 |
| Comparative example 25 | 0.856 | ***0.008*** | ***0.008*** | ***0.008*** | 0.100 | 0.020 | 0.000 | 0.010 |
| Comparative example 25 | 0.720 | ***0.060*** | ***0.050*** | ***0.050*** | 0.100 | 0.020 | 0.000 | 0.010 |

| Sample No. | $(Fe_{(1-(a+b+c))}M_aB_bCr_c)_{1-d}C_d$ ($\alpha = \beta = 0$) S (wt %) | P/S | Ti (wt %) | XRD | Constant temperature and humidity test 80° C. × 85 RH/h (h) | Bs (T) | Hc (A/m) | μ' (1 kHz) |
|---|---|---|---|---|---|---|---|---|
| Example 29 | 0.005 | 2.00 | 0.010 | amorphous phase | 85 | 1.49 | 2.2 | 53600 |
| Example 30 | 0.005 | 2.00 | 0.010 | amorphous phase | 86 | 1.51 | 2.3 | 53300 |
| Example 31 | 0.005 | 2.00 | 0.010 | amorphous phase | 85 | 1.47 | 2.6 | 52600 |
| Example 32 | 0.005 | 2.00 | 0.010 | amorphous phase | 85 | 1.48 | 2.4 | 52800 |
| Example 33 | 0.005 | 2.00 | 0.010 | amorphous phase | 85 | 1.38 | 2.8 | 49700 |
| Example 34 | 0.005 | 2.00 | 0.010 | amorphous phase | 84 | 1.36 | 2.9 | 50300 |
| Example 35 | 0.005 | 2.00 | 0.010 | amorphous phase | 86 | 1.51 | 2.1 | 53800 |
| Example 36 | 0.005 | 2.00 | 0.010 | amorphous phase | 87 | 1.49 | 2.1 | 54100 |
| Example 37 | 0.005 | 2.00 | 0.010 | amorphous phase | 86 | 1.48 | 2.3 | 53500 |
| Example 38 | 0.005 | 2.00 | 0.010 | amorphous phase | 83 | 1.39 | 2.2 | 51300 |
| Example 39 | 0.005 | 2.00 | 0.010 | amorphous phase | 85 | 1.36 | 2.9 | 50900 |
| Example 40 | 0.005 | 2.00 | 0.010 | amorphous phase | 84 | 1.36 | 2.9 | 50500 |
| Example 41 | 0.005 | 2.00 | 0.010 | amorphous phase | 86 | 1.52 | 2.2 | 53200 |
| Example 42 | 0.005 | 2.00 | 0.010 | amorphous phase | 85 | 1.36 | 2.8 | 49800 |

TABLE 4-continued

| | | | | | | | | |
|---|---|---|---|---|---|---|---|---|
| Comparative example 25 | 0.005 | 2.00 | 0.010 | ***crystal phase*** | 87 | 1.51 | ***337*** | ***238*** |
| Comparative example 25 | 0.005 | 2.00 | 0.010 | amorphous phase | 83 | ***1.19*** | 2.9 | ***48900*** |

TABLE 5

| | $(Fe_{(1-(a+b+c))}M_aB_bCr_c)_{1-d}C_d$ ($\alpha = \beta = 0$) | | | | | | | | | | | | | | | |
|---|---|---|---|---|---|---|---|---|---|---|---|---|---|---|---|---|
| Sample No. | Fe | Nb | Hf a | Zr | B b | Cr c | C d | P (wt %) | S (wt %) | P/S | Ti (wt %) | XRD | Constant temperature and humidity test 80° C. × 85 RH/h (h) | Bs (T) | Hc (A/m) | μ' (1 kHz) |
| Comparative example 27 | 0.907 | 0.070 | 0.000 | 0.000 | ***0.003*** | 0.020 | 0.000 | 0.010 | 0.005 | 2.00 | 0.010 | ***crystal phase*** | 83 | 1.70 | ***231*** | ***782*** |
| Example 43 | 0.905 | 0.070 | 0.000 | 0.000 | 0.005 | 0.020 | 0.000 | 0.010 | 0.005 | 2.00 | 0.010 | amorphous phase | 85 | 1.73 | 2.1 | 54100 |
| Example 44 | 0.890 | 0.070 | 0.000 | 0.000 | 0.020 | 0.020 | 0.000 | 0.010 | 0.005 | 2.00 | 0.010 | amorphous phase | 83 | 1.63 | 2.1 | 54100 |
| Example 45 | 0.860 | 0.070 | 0.000 | 0.000 | 0.050 | 0.020 | 0.000 | 0.010 | 0.005 | 2.00 | 0.010 | amorphous phase | 85 | 1.59 | 2.2 | 53600 |
| Example 25 | 0.810 | 0.070 | 0.000 | 0.000 | 0.100 | 0.020 | 0.000 | 0.010 | 0.005 | 2.00 | 0.010 | amorphous phase | 83 | 1.45 | 2.4 | 52800 |
| Example 46 | 0.770 | 0.070 | 0.000 | 0.000 | 0.140 | 0.020 | 0.000 | 0.010 | 0.005 | 2.00 | 0.010 | amorphous phase | 85 | 1.37 | 2.5 | 52500 |
| Example 47 | 0.730 | 0.070 | 0.000 | 0.000 | 0.180 | 0.020 | 0.000 | 0.010 | 0.005 | 2.00 | 0.010 | amorphous phase | 83 | 1.27 | 2.5 | 52600 |
| Example 48 | 0.710 | 0.070 | 0.000 | 0.000 | 0.200 | 0.020 | 0.000 | 0.010 | 0.005 | 2.00 | 0.010 | amorphous phase | 87 | 1.25 | 2.6 | 52200 |
| Comparative example 28 | 0.690 | 0.070 | 0.000 | 0.000 | ***0.220*** | 0.020 | 0.000 | 0.010 | 0.005 | 2.00 | 0.010 | amorphous phase | 85 | ***1.11*** | 2.6 | 51300 |

TABLE 6

| | $(Fe_{(1-(a+b+c))}M_aB_bCr_c)_{1-d}$ ($\alpha = \beta = 0$) | | | | | | | | | | | | | | | |
|---|---|---|---|---|---|---|---|---|---|---|---|---|---|---|---|---|
| Sample No. | Fe | Nb | Hf a | Zr | B b | Cr c | C d | P (wt %) | S (wt %) | P/S | Ti (wt %) | XRD | Constant temperature and humidity test 80° C. × 85 RH/h (h) | Bs (T) | Hc (A/m) | μ' (1 kHz) |
| Comparative example 29 | 0.830 | 0.070 | 0.000 | 0.000 | 0.100 | ***0.000*** | 0.000 | 0.010 | 0.005 | 2.00 | 0.010 | amorphous phase | ***11*** | 1.50 | 2.5 | 53100 |
| Example 49 | 0.829 | 0.070 | 0.000 | 0.000 | 0.100 | 0.001 | 0.000 | 0.010 | 0.005 | 2.00 | 0.010 | amorphous phase | 80 | 1.49 | 2.9 | 51200 |
| Example 50 | 0.825 | 0.070 | 0.000 | 0.000 | 0.100 | 0.005 | 0.000 | 0.010 | 0.005 | 2.00 | 0.010 | amorphous phase | 81 | 1.48 | 2.4 | 52800 |
| Example 51 | 0.820 | 0.070 | 0.000 | 0.000 | 0.100 | 0.010 | 0.000 | 0.010 | 0.005 | 2.00 | 0.010 | amorphous phase | 83 | 1.45 | 2.0 | 54300 |
| Example 25 | 0.810 | 0.070 | 0.000 | 0.000 | 0.100 | 0.020 | 0.000 | 0.010 | 0.005 | 2.00 | 0.010 | amorphous phase | 83 | 1.45 | 2.4 | 52800 |
| Example 52 | 0.790 | 0.070 | 0.000 | 0.000 | 0.100 | 0.040 | 0.000 | 0.010 | 0.005 | 2.00 | 0.010 | amorphous phase | 86 | 1.38 | 2.5 | 53100 |
| Comparative example 30 | 0.780 | 0.070 | 0.000 | 0.000 | 0.100 | ***0.050*** | 0.000 | 0.010 | 0.005 | 2.00 | 0.010 | amorphous phase | 91 | ***1.18*** | 2.6 | 52200 |

TABLE 7

| | $(Fe_{(1-(a+b+c))}M_aB_bCr_c)_{1-d}C_d$ ($\alpha = \beta = 0$) | | | | | | | | | | | | | | | |
|---|---|---|---|---|---|---|---|---|---|---|---|---|---|---|---|---|
| Sample No. | Fe | Nb | Hf a | Zr | B b | Cr c | C d | P (wt %) | S (wt %) | P/S | Ti (wt %) | XRD | Constant temperature and humidity test 80° C. × 85 RH/h (h) | Bs (T) | Hc (A/m) | μ' (1 kHz) |
| Comparative example 31 | 0.810 | 0.070 | 0.000 | 0.000 | 0.100 | 0.020 | 0.000 | ***0.000*** | 0.010 | ***0.00*** | 0.010 | amorphous phase | ***28*** | 1.46 | ***4.2*** | ***44200*** |
| Example 53 | 0.810 | 0.070 | 0.000 | 0.000 | 0.100 | 0.020 | 0.000 | 0.001 | 0.010 | 0.10 | 0.010 | amorphous phase | 78 | 1.41 | 2.7 | 52500 |
| Example 54 | 0.810 | 0.070 | 0.000 | 0.000 | 0.100 | 0.020 | 0.000 | 0.005 | 0.010 | 0.50 | 0.010 | amorphous phase | 81 | 1.43 | 2.6 | 52600 |
| Example 9 | 0.810 | 0.070 | 0.000 | 0.000 | 0.100 | 0.020 | 0.000 | 0.010 | 0.010 | 1.00 | 0.010 | amorphous phase | 86 | 1.46 | 2.4 | 52900 |
| Example 55 | 0.810 | 0.070 | 0.000 | 0.000 | 0.100 | 0.020 | 0.000 | 0.020 | 0.010 | 2.00 | 0.010 | amorphous phase | 87 | 1.44 | 2.1 | 53300 |
| Example 56 | 0.810 | 0.070 | 0.000 | 0.000 | 0.100 | 0.020 | 0.000 | 0.040 | 0.010 | 4.00 | 0.010 | amorphous phase | 90 | 1.45 | 2.4 | 52100 |
| Example 57 | 0.810 | 0.070 | 0.000 | 0.000 | 0.100 | 0.020 | 0.000 | 0.050 | 0.010 | 5.00 | 0.010 | amorphous phase | 92 | 1.43 | 2.4 | 51600 |
| Comparative example 32 | 0.810 | 0.070 | 0.000 | 0.000 | 0.100 | 0.020 | 0.000 | ***0.070*** | 0.010 | 7.00 | 0.010 | amorphous phase | 91 | 1.41 | 3.9 | 46900 |
| Comparative example 33 | 0.810 | 0.070 | 0.000 | 0.000 | 0.100 | 0.020 | 0.000 | 0.010 | ***0.000*** | — | 0.010 | amorphous phase | 70 | 1.46 | ***4.4*** | ***43400*** |
| Example 58 | 0.810 | 0.070 | 0.000 | 0.000 | 0.100 | 0.020 | 0.000 | 0.010 | 0.001 | 10.00 | 0.010 | amorphous phase | 82 | 1.45 | 2.9 | 51000 |
| Example 25 | 0.810 | 0.070 | 0.000 | 0.000 | 0.100 | 0.020 | 0.000 | 0.010 | 0.005 | 2.00 | 0.010 | amorphous phase | 83 | 1.45 | 2.4 | 52800 |
| Example 9 | 0.810 | 0.070 | 0.000 | 0.000 | 0.100 | 0.020 | 0.000 | 0.010 | 0.010 | 1.00 | 0.010 | amorphous phase | 86 | 1.46 | 2.4 | 52900 |
| Example 59 | 0.810 | 0.070 | 0.000 | 0.000 | 0.100 | 0.020 | 0.000 | 0.010 | 0.020 | 0.50 | 0.010 | amorphous phase | 87 | 1.44 | 2.3 | 53500 |
| Example 60 | 0.810 | 0.070 | 0.000 | 0.000 | 0.100 | 0.020 | 0.000 | 0.010 | 0.040 | 0.25 | 0.010 | amorphous phase | 87 | 1.42 | 2.5 | 52900 |
| Example 61 | 0.810 | 0.070 | 0.000 | 0.000 | 0.100 | 0.020 | 0.000 | 0.010 | 0.050 | 0.20 | 0.010 | amorphous phase | 89 | 1.42 | 2.8 | 52400 |
| Comparative example 34 | 0.810 | 0.070 | 0.000 | 0.000 | 0.100 | 0.020 | 0.000 | 0.010 | ***0.070*** | 0.14 | 0.010 | amorphous phase | 91 | 1.40 | 4.1 | 50200 |
| Comparative example 35 | 0.810 | 0.070 | 0.000 | 0.000 | 0.100 | 0.020 | 0.000 | 0.003 | 0.040 | ***0.08*** | 0.010 | amorphous phase | 80 | 1.40 | ***4.6*** | ***47300*** |
| Comparative example 36 | 0.810 | 0.070 | 0.000 | 0.000 | 0.100 | 0.020 | 0.000 | 0.023 | 0.002 | ***11.5*** | 0.010 | amorphous phase | 82 | 1.41 | ***4.2*** | ***47700*** |

TABLE 8

| | $(Fe_{(1-(a+b+c))}M_aB_bCr_c)_{1-d}C_d$ ($\alpha = \beta = 0$) | | | | | | | | | | | | | | | |
|---|---|---|---|---|---|---|---|---|---|---|---|---|---|---|---|---|
| Sample No. | Fe | Nb | Hf a | Zr | B b | Cr c | C d | P (wt %) | S (wt %) | P/S | Ti (wt %) | XRD | Constant temperature and humidity test 80° C. × 85 RH/h (h) | Bs (T) | Hc (A/m) | μ' (1 kHz) |
| Comparative example 37 | 0.810 | 0.070 | 0.000 | 0.000 | 0.100 | 0.020 | 0.000 | 0.010 | 0.005 | 2.00 | ***0.000*** | amorphous phase | 69 | 1.46 | ***4.1*** | ***40900*** |
| Example 62 | 0.810 | 0.070 | 0.000 | 0.000 | 0.100 | 0.020 | 0.000 | 0.010 | 0.005 | 2.00 | 0.001 | amorphous phase | 80 | 1.46 | 2.7 | 51700 |
| Example 63 | 0.810 | 0.070 | 0.000 | 0.000 | 0.100 | 0.020 | 0.000 | 0.010 | 0.005 | 2.00 | 0.005 | amorphous phase | 82 | 1.44 | 2.5 | 52400 |
| Example 25 | 0.810 | 0.070 | 0.000 | 0.000 | 0.100 | 0.020 | 0.000 | 0.010 | 0.005 | 2.00 | 0.010 | amorphous phase | 83 | 1.45 | 2.4 | 52800 |
| Example 64 | 0.810 | 0.070 | 0.000 | 0.000 | 0.100 | 0.020 | 0.000 | 0.010 | 0.005 | 2.00 | 0.020 | amorphous phase | 85 | 1.43 | 2.2 | 53000 |
| Example 65 | 0.810 | 0.070 | 0.000 | 0.000 | 0.100 | 0.020 | 0.000 | 0.010 | 0.005 | 2.00 | 0.040 | amorphous phase | 87 | 1.42 | 2.5 | 52600 |
| Example 66 | 0.810 | 0.070 | 0.000 | 0.000 | 0.100 | 0.020 | 0.000 | 0.010 | 0.005 | 2.00 | 0.060 | amorphous phase | 88 | 1.41 | 2.6 | 51800 |

TABLE 8-continued

| | $(Fe_{(1-(a+b+c))}M_aB_bCr_c)_{1-d}C_d$ ($\alpha = \beta = 0$) | | | | | | | | | | | | | | | |
|---|---|---|---|---|---|---|---|---|---|---|---|---|---|---|---|---|
| Sample No. | Fe | Nb | Hf a | Zr | B b | Cr c | C d | P (wt %) | S (wt %) | P/S | Ti (wt %) | XRD | Constant temperature and humidity test 80° C. × 85 RH/h (h) | Bs (T) | Hc (A/m) | μ' (1 kHz) |
| Example 67 | 0.810 | 0.070 | 0.000 | 0.000 | 0.100 | 0.020 | 0.000 | 0.010 | 0.005 | 2.00 | 0.080 | amorphous phase | 90 | 1.41 | 2.8 | 51200 |
| Comparative example 38 | 0.810 | 0.070 | 0.000 | 0.000 | 0.100 | 0.020 | 0.000 | 0.010 | 0.005 | 2.00 | ***0.100*** | amorphous phase | 88 | 1.37 | ***4.8*** | ***39100*** |

TABLE 9

| | $(Fe_{(1-(a+b+c))}M_aB_bCr_c)_{1-d}C_d$ ($\alpha = \beta = 0$) | | | | | | | |
|---|---|---|---|---|---|---|---|---|
| Sample No. | Fe | Nb | Hf a | Zr | B b | Cr c | C d | P (wt %) |
| Example 68 | 0.810 | 0.070 | 0.000 | 0.000 | 0.100 | 0.020 | 0.001 | 0.010 |
| Example 69 | 0.810 | 0.070 | 0.000 | 0.000 | 0.100 | 0.020 | 0.005 | 0.010 |
| Example 70 | 0.810 | 0.070 | 0.000 | 0.000 | 0.100 | 0.020 | 0.010 | 0.010 |
| Example 71 | 0.810 | 0.070 | 0.000 | 0.000 | 0.100 | 0.020 | 0.020 | 0.010 |
| Example 72 | 0.810 | 0.070 | 0.000 | 0.000 | 0.100 | 0.020 | 0.040 | 0.010 |
| Comparative example 39 | 0.810 | 0.070 | 0.000 | 0.000 | 0.100 | 0.020 | ***0.045*** | 0.010 |
| Example 73 | 0.850 | 0.030 | 0.000 | 0.000 | 0.100 | 0.020 | 0.001 | 0.010 |
| Example 74 | 0.740 | 0.140 | 0.000 | 0.000 | 0.100 | 0.020 | 0.001 | 0.010 |
| Example 75 | 0.850 | 0.030 | 0.000 | 0.000 | 0.100 | 0.020 | 0.040 | 0.010 |
| Example 76 | 0.740 | 0.140 | 0.000 | 0.000 | 0.100 | 0.020 | 0.040 | 0.010 |

| | $(Fe_{(1-(a+b+c))}M_aB_bCr_c)_{1-d}C_d$ ($\alpha = \beta = 0$) | | | | | | | |
|---|---|---|---|---|---|---|---|---|
| Sample No. | S (wt %) | P/S | Ti (wt %) | XRD | Constant temperature and humidity test 80° C. × 85 RH/h (h) | Bs (T) | Hc (A/m) | μ' (1 kHz) |
| Example 68 | 0.005 | 2.00 | 0.010 | amorphous phase | 83 | 1.45 | 1.8 | 53900 |
| Example 69 | 0.005 | 2.00 | 0.010 | amorphous phase | 84 | 1.45 | 1.7 | 54100 |
| Example 70 | 0.005 | 2.00 | 0.010 | amorphous phase | 84 | 1.44 | 1.6 | 54400 |
| Example 71 | 0.005 | 2.00 | 0.010 | amorphous phase | 84 | 1.42 | 1.5 | 54000 |
| Example 72 | 0.005 | 2.00 | 0.010 | amorphous phase | 85 | 1.40 | 1.7 | 54300 |
| Comparative example 39 | 0.005 | 2.00 | 0.010 | ***crystal phase*** | 85 | 1.40 | ***194*** | ***938*** |
| Example 73 | 0.005 | 2.00 | 0.010 | amorphous phase | 85 | 1.51 | 1.9 | 54000 |
| Example 74 | 0.005 | 2.00 | 0.010 | amorphous phase | 86 | 1.38 | 1.9 | 50600 |
| Example 75 | 0.005 | 2.00 | 0.010 | amorphous phase | 85 | 1.47 | 1.7 | 54200 |
| Example 76 | 0.005 | 2.00 | 0.010 | amorphous phase | 87 | 1.35 | 1.8 | 51700 |

TABLE 10

| | a~d, P, S, Ti, α and β are same as Example 25 | | | | | |
|---|---|---|---|---|---|---|
| Sample No. | M | XRD | Constant temperature and humidity test 80° C. × 85 RH/h (h) | Bs (T) | Hc (A/m) | μ' (1 kHz) |
| Example 25 | Nb | amorphous phase | 83 | 1.45 | 2.4 | 52800 |
| Example 25a | Hf | amorphous phase | 83 | 1.45 | 2.5 | 52300 |
| Example 25b | Zr | amorphous phase | 84 | 1.46 | 2.5 | 52100 |
| Example 25c | Ta | amorphous phase | 83 | 1.45 | 2.5 | 51900 |

TABLE 10-continued

| | a~d, P, S, Ti, α and β are same as Example 25 | | | | | |
|---|---|---|---|---|---|---|
| Sample No. | M | XRD | Constant temperature and humidity test 80° C. × 85 RH/h (h) | Bs (T) | Hc (A/m) | μ' (1 kHz) |
| Example 25d | Mo | amorphous phase | 83 | 1.45 | 2.4 | 53000 |
| Example 25e | W | amorphous phase | 83 | 1.44 | 2.3 | 53100 |
| Example 25f | V | amorphous phase | 82 | 1.44 | 2.4 | 52600 |

TABLE 11

| | $Fe_{(1-(\alpha+\beta))}X1_{\alpha}X2_{\beta}$ (a to d, P, S and Ti are same as example 22) | | | | | | | | |
|---|---|---|---|---|---|---|---|---|---|
| Sample No. | X1 Type | X1 α {1 − (a + b + c)}(1 − d) | X2 Type | X2 β {1 − (a + b + c)}(1 − d) | XRD | Constant temperature and humidity test 80° C. × 85 RH/h (h) | Bs (T) | Hc (A/m) | μ' (1 kHz) |
| Example 22 | — | 0.000 | — | 0.000 | amorphous phase | 82 | 1.74 | 2.1 | 54100 |
| Example 77 | Co | 0.010 | — | 0.000 | amorphous phase | 83 | 1.74 | 2.1 | 53900 |
| Example 78 | Co | 0.100 | — | 0.000 | amorphous phase | 82 | 1.76 | 2.3 | 53200 |
| Example 79 | Co | 0.400 | — | 0.000 | amorphous phase | 79 | 1.77 | 2.5 | 52500 |
| Example 80 | Ni | 0.010 | — | 0.000 | amorphous phase | 84 | 1.73 | 2.1 | 54200 |
| Example 81 | Ni | 0.100 | — | 0.000 | amorphous phase | 83 | 1.73 | 2.0 | 54900 |
| Example 82 | Ni | 0.400 | — | 0.000 | amorphous phase | 84 | 1.70 | 2.0 | 55300 |
| Example 83 | — | 0.000 | Al | 0.030 | amorphous phase | 82 | 1.74 | 2.0 | 54500 |
| Example 84 | — | 0.000 | Mn | 0.030 | amorphous phase | 81 | 1.72 | 2.2 | 53700 |
| Example 85 | — | 0.000 | Zn | 0.030 | amorphous phase | 80 | 1.76 | 2.1 | 53400 |
| Example 86 | — | 0.000 | Sn | 0.030 | amorphous phase | 82 | 1.75 | 2.2 | 53000 |
| Example 87 | — | 0.000 | Bi | 0.030 | amorphous phase | 83 | 1.73 | 2.4 | 54400 |
| Example 88 | — | 0.000 | Y | 0.030 | amorphous phase | 80 | 1.74 | 2.0 | 53400 |
| Example 89 | Co | 0.100 | Al | 0.030 | amorphous phase | 82 | 1.75 | 2.1 | 53800 |

TABLE 12

| | a to c, P, S, and Ti are same as Example 22 | | | | | | | | |
|---|---|---|---|---|---|---|---|---|---|
| Sample No. | Rotating speed of roll (m/sec) | Heat treating temperature (° C.) | Average grain size of initial fine crystal (nm) | Average grain size of Fe-based nanocrystal alloy (nm) | XRD | Constant temperature and humidity test 80° C. × 85 RH/h (h) | Bs (T) | Hc (A/m) | μ' (1 kHz) |
| Example 90 | 55 | 450 | No initial fine crystal | 3 | amorphous phase | 83 | 1.68 | 2.5 | 51900 |
| Example 91 | 50 | 400 | 0.1 | 3 | amorphous phase | 81 | 1.69 | 2.5 | 53100 |
| Example 92 | 40 | 450 | 0.3 | 5 | amorphous phase | 82 | 1.70 | 2.1 | 53600 |
| Example 93 | 40 | 500 | 0.3 | 10 | amorphous phase | 83 | 1.71 | 2.0 | 54500 |

TABLE 12-continued

| Sample No. | Rotating speed of roll (m/sec) | Heat treating temperature (° C.) | Average grain size of initial fine crystal (nm) | Average grain size of Fe-based nanocrystal alloy (nm) | XRD | Constant temperature and humidity test 80° C. × 85 RH/h (h) | Bs (T) | Hc (A/m) | μ' (1 kHz) |
|---|---|---|---|---|---|---|---|---|---|
| a to c, P, S, and Ti are same as Example 22 | | | | | | | | | |
| Example 94 | 40 | 550 | 0.3 | 13 | amorphous phase | 83 | 1.73 | 2.1 | 54300 |
| Example 22 | 30 | 550 | 10.0 | 20 | amorphous phase | 82 | 1.74 | 2.1 | 54100 |
| Example 95 | 30 | 600 | 10.0 | 30 | amorphous phase | 83 | 1.74 | 2.2 | 53300 |
| Example 96 | 20 | 650 | 15.0 | 50 | amorphous phase | 82 | 1.79 | 2.6 | 53100 |

Table 1 shows the examples having all of P, S, and Ti in the predetermined ranges, and also varying the Nb amount and B amount within the predetermined ranges. Also, Table 2 shows the comparative examples which do not include one or more of P, S, and Ti, and varying the Nb amount and the B amount within the predetermined ranges.

The examples shown in Table 1 having the content of each component within the predetermined range all exhibited favorable saturation magnetic flux density, coercivity, magnetic permeability, and corrosion resistance.

On the contrary to this, the comparative examples shown in Table 2 which do not include one or more of P, S, and Ti had unfavorable magnetic permeability. The comparative example which did not include P had significantly decreased corrosion resistance. The comparative example which the content (b) of B was 0.005 had a ribbon before the heat treatment composed of the crystal phase, and the coercivity after the heat treatment significantly increased and the magnetic permeability significantly decreased. On the contrary to this, even if (b) was 0.005, the example 22 which included all of P, S, and Ti had a ribbon before the heat treatment composed of amorphous phase. Further, by heat treating the ribbon having low content of B and composed of the amorphous phase, the sample having excellent saturation magnetic flux density (Bs), coercivity (Hc), and magnetic permeability (μ') was able to obtain.

Table 3 shows the examples and the comparative examples of which the Nb amount and the M amount were varied. Table 4 shows the examples and the comparative examples of which the type and content of M were varied.

The examples shown in Table 3 and Table 4 which had M amount within the predetermined range all exhibited favorable saturation magnetic flux density, coercivity, magnetic permeability, and corrosion resistance regardless of the type of M. On the contrary, the comparative example having too little M amount had a ribbon before the heat treatment composed of the crystal phase, and the coercivity after the heat treatment significantly increased and the magnetic permeability significantly decreased. The comparative example having too much M content exhibited unfavorable saturation magnetic flux density. Also, some comparative examples showed decreased magnetic permeability.

Table 5 shows the examples and the comparative examples of which the amount of B was varied.

The examples shown in Table 5 having the amount of B within the predetermined range exhibited favorable saturation magnetic flux density, coercivity, magnetic permeability, and corrosion resistance. On the other hand, the comparative example of which the amount of B was too little had a ribbon before the heat treatment composed of a crystal phase, and the coercivity after the heat treatment significantly increased and the magnetic permeability significantly decreased. The comparative example of which the amount of B was too large exhibited unfavorable saturation magnetic flux density.

Table 6 shows examples and comparative examples of which the amount of Cr was varied.

The example in Table 6 of which the amount of Cr was within the predetermined rage all exhibited favorable saturation magnetic flux density, coercivity, magnetic permeability, and corrosion resistance. On the other hand, the comparative example of which the amount of Cr was too little showed significantly decreased corrosion resistance. The comparative example of which the amount of Cr was too much showed decreased saturation magnetic flux density.

Table 7 shows examples and comparative examples of which the amount of P and the amount of S were varied.

The examples shown in Table 7 having the amount of P and the amount of S within the predetermined range exhibited favorable saturation magnetic flux density, coercivity, magnetic permeability, and corrosion resistance. On the contrary, the comparative example of which the amount of P was out of the predetermined range, and the comparative example of which the amount of S was out of the predetermined range exhibited increased coercivity and decreased magnetic permeability. The comparative example of which the amount of P was too small showed significantly decreased corrosion resistance. Also, even when the amount of P and the amount of S were within the predetermined range, if P/S was too small or too large, then the coercivity was increased and the magnetic permeability was decreased.

Table 8 shows the examples and the comparative examples of which the amount of Ti was varied.

The examples of Table 8 having the amount of Ti within the predetermined range exhibited favorable saturation magnetic flux density, coercivity, magnetic permeability, and corrosion resistance. On the contrary to this, the comparative example having the amount of Ti out of the predetermined range exhibited increased coercivity and decreased specific magnetic permeability.

Table 9 shows the examples and the comparative examples of which the amount of C was varied while the amount of Nb was varied within the predetermined range.

The examples of Table 9 having the amount of C within the predetermined range exhibited favorable saturation magnetic flux density, coercivity, magnetic permeability, and corrosion resistance. On the contrary, the comparative example having excessive amount of C had a ribbon before the heat treatment composed of the crystal phase and the coercivity after the heat treatment significantly increased and the magnetic permeability significantly decreased.

Table 10 shows the examples of which the type of M of the example 25 was changed.

According to Table 10, favorable properties were exhibited even when the type of M was changed.

Table 11 shows the examples of which a part of Fe of the example 22 was substituted with X1 and/or X2.

Favorable properties were exhibited even when a part of Fe was substituted with X1 and/or X2.

Table 12 shows the examples of which the average grain size of the initial fine crystals and the average grain size of the Fe-based nanocrystal alloy of the example 22 were varied by changing the rotating speed and/or the heat treatment temperature of the roll.

When the average grain size of the initial fine crystal was 0.3 to 10 nm, and the average grain size of the Fe-based nanocrystal alloy was 5 to 30 nm, the coercivity and the magnetic permeability were more favorable compared to the case of which the average grain size of the initial fine crystal and the average grain size of the Fe-based nanocrystal alloy were out of the above mentioned range.

The invention claimed is:

1. A soft magnetic alloy consisting of major alloying elements having a compositional formula of $((Fe_{(1-(\alpha+\beta)}X1_{\alpha}X2_{\beta})_{(1-(a+b+c))}M_aB_bCr_c)_{1-d}C_d$, minor alloying elements consisting of P, S and Ti, and one or more elements other than those of the major alloying elements and the minor alloying elements as an inevitable impurity, wherein X1 is one or more selected from the group consisting of Co and Ni, X2 is one or more selected from the group consisting of Al, Mn, Ag, Zn, Sn, As, Sb, Bi, and rare earth elements, "M" is one or more selected from the group consisting of Nb, Hf, Zr, Ta, Mo, W, and V, a, b, c, d, α, and β are atomic ratios, $0.030 \le a \le 0.14$, $0.005 \le b \le 0.20$, $0.001 \le c \le 0.040$, $0 \le d \le 0.040$, $\alpha \ge 0$, $\beta \ge 0$, and $0 \le \alpha+\beta \le 0.50$ are satisfied, a content of the P is 0.010 to 0.050 wt % with respect to 100 wt % of the soft magnetic alloy, a content of the S is 0.005 to 0.040 wt % with respect to 100 wt % of the soft magnetic alloy, and a content of the Ti is 0.005 to 0.040 wt % with respect to 100 wt % of the soft magnetic alloy, a value obtained by dividing the content of the P by the content of the S is P/S, which satisfies $0.10 \le P/S \le 10$, a content of the elements other than those of the major alloying elements and the minor alloying elements is 0.1 wt % or less with respect to 100 wt % of the soft magnetic alloy, a magnetic permeability (μ') is 49000 or more, a saturation magnetic flux density (Bs) is 1.25 T or more, and a coercivity (Hc) is 2.5 A/m or less.

2. The soft magnetic alloy as set forth in claim 1, wherein $0.73 \le 1-(a+b+c) \le 0.93$ is satisfied.

3. The soft magnetic alloy as set forth in claim 1, wherein $0 \le \alpha\{1-(a+b+c)\}(1-d) \le 0.40$ is satisfied.

4. The soft magnetic alloy as set forth in claim 1, wherein $\alpha=0$ is satisfied.

5. The soft magnetic alloy as set forth in claim 1, wherein $0 \le \beta\{1-(\alpha+b+c)\}(1-d) \le 0.030$ is satisfied.

6. The soft magnetic alloy as set forth in claim 1, wherein $\beta=0$ is satisfied.

7. The soft magnetic alloy as set forth in claim 1, wherein $\alpha=\beta=0$ is satisfied.

8. The soft magnetic alloy as set forth in claim 1, wherein said soft magnetic alloy is formed in a ribbon form.

9. The soft magnetic alloy as set forth in claim 1, wherein said soft magnetic alloy is formed in a powder form.

10. The soft magnetic alloy as set forth in claim 1, comprising a nanohetero structure composed of an amorphous phase and initial fine crystals, and said initial fine crystals exist in said amorphous phase, wherein the initial fine crystals are crystals present before any heat treatment.

11. The soft magnetic alloy as set forth in claim 10, wherein the initial fine crystals have an average grain size of 0.3 to 10 nm.

12. The soft magnetic alloy as set forth in claim 1, comprising a structure composed of Fe-based nanocrystals.

13. The soft magnetic alloy as set forth in claim 12, wherein the Fe-based nanocrystals have an average grain size of 5 to 30 nm.

14. A magnetic core comprising the soft magnetic alloy as set forth in claim 1.

15. An inductor comprising the magnetic core as set forth in claim 14.

16. A transformer comprising the magnetic core as set forth in claim 14.

17. A motor comprising the magnetic core as set forth in claim 14.

* * * * *